US005788111A

United States Patent [19]

Waugh

[11] Patent Number: 5,788,111

[45] Date of Patent: Aug. 4, 1998

[54] DRINKING VESSEL

[75] Inventor: Clive Grenville Alan Waugh, Northwood, United Kingdom

[73] Assignee: Charles (Glassware) Ltd., Borehamwood, United Kingdom

[21] Appl. No.: 535,173

[22] PCT Filed: May 6, 1994

[86] PCT No.: PCT/GB94/00978

§ 371 Date: Oct. 19, 1995

§ 102(e) Date: Oct. 19, 1995

[87] PCT Pub. No.: WO95/00057

PCT Pub. Date: Jan. 5, 1995

[30] Foreign Application Priority Data

Jun. 18, 1993 [GB] United Kingdom ..... 9312684

[51] Int. Cl.[6] ..... B05D 5/02; B05D 7/22; B65D 23/02

[52] U.S. Cl. ..... 220/458; 220/457; 220/608; 220/626; 427/181; 427/197; 427/279; 427/287

[58] Field of Search ..... 220/608, 458, 220/457, 454, 626; 427/181, 197, 199, 287, 279, 256, 314, 374.4, 397.8

[56] References Cited

U.S. PATENT DOCUMENTS

| | | | |
|---|---|---|---|
| 3,496,006 | 2/1970 | Rideout et al. | 427/256 X |
| 3,506,469 | 4/1970 | Surrey | 427/197 X |
| 3,696,741 | 10/1972 | Reinke | 427/197 X |
| 3,898,092 | 8/1975 | Rea | 501/20 |
| 4,041,194 | 8/1977 | Jenkins | 427/197 X |
| 4,279,938 | 7/1981 | Hildebrand | 428/424 |
| 5,034,244 | 7/1991 | Berrer et al. | 427/54.1 |
| 5,066,360 | 11/1991 | Daley et al. | 156/660 |

*Primary Examiner*—Allan N. Shoap
*Assistant Examiner*—Niki M. Kopsidas
*Attorney, Agent, or Firm*—Christie, Parker & Hale, LLP

[57] ABSTRACT

An inside surface of a drinking vessel is treated with a material suitable for providing nucleation sites to encourage the formation of bubbles in a liquid containing a gas such as carbon dioxide or $CO_2$/nitrogen mixture. The material may be printed upon the internal surface.

16 Claims, 5 Drawing Sheets

Fig. 7A
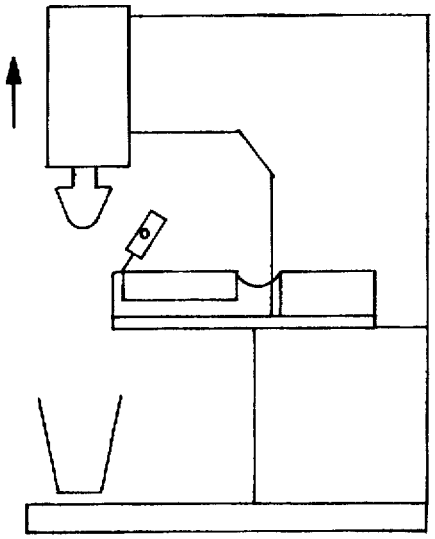
Fig. 7B
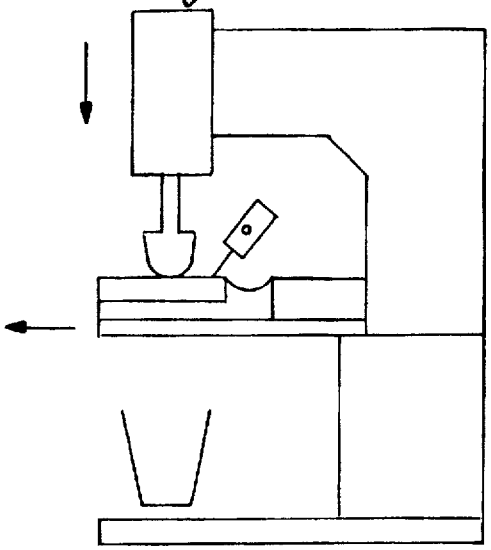
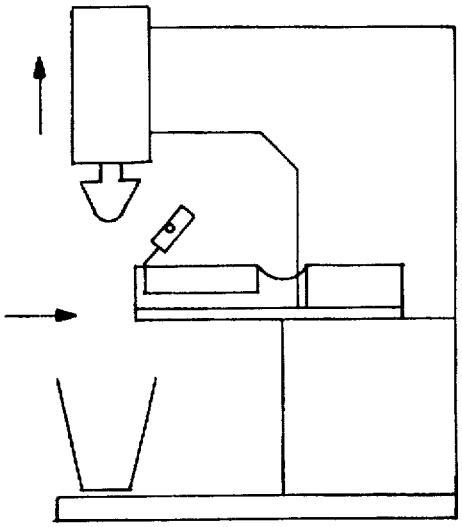
Fig. 7C
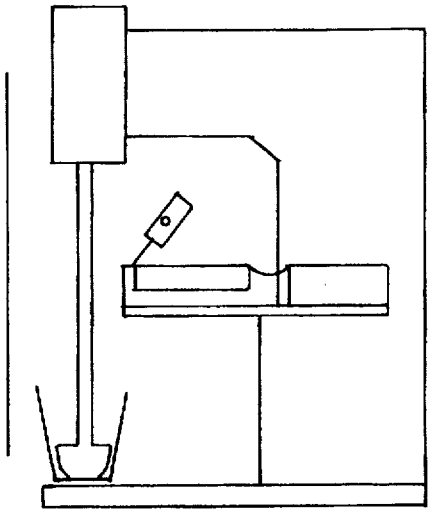
Fig. 7D

DRINKING VESSEL

This invention relates to a drinking vessel. In particular, it relates to a vessel in the form of a glass for containing beverages containing gas such as carbon dioxide or a carbon dioxide/nitrogen mix for example, particularly beverages such as beer or sparkling wines.

Many beverages contain dissolved gases such as carbon dioxide or carbon dioxide/nitrogen either as a result of fermentation (eg. beer, sparkling wines) or by the addition of the gas, eg. adding carbon dioxide to carbonate a beverage. With drinks such as beer and lager and cider, a desirable feature of the product is the head which forms on the top of the product. The head is formed by the dissolved carbon dioxide in the liquid being released upon the liquid being poured into the vessel. In some products the head may be formed from bubbles of $CO_2/N_2$. However, if the beverage is allowed to stand for any length of time then the head will tend to disperse and disappear. Thus, a glass of beer or lager that has been left undrunk or only partially drunk for some time loses its head and becomes unattractive.

In attempts to improve head retention the principals of nucleation have been applied. It is known that bubbles tend to form at an interface or surface (eg. the walls of the container) rather than in the bulk of a liquid. It has also been found that bubble formation increases by a process known as nucleation on an irregular surface such as imperfections or scratches on the glass surface, or on specks of dust or other particles. The interior surface of a drinking glass is conventionally made to be as smooth as possible which tends to reduce the amount of bubbles produced by heterogeneous nucleation and to hasten the disappearance of the head. Recently, attempts have been made to design vessels which encourage heterogeneous nucleation by roughening the interior surface of selected parts of a drinking vessel. This has been done by using techniques such as etching with lasers or sandblasting to roughen and form pits in the surface of the glass.

The problem with this type of approach is that it may tend to weaken the structure of the glass itself, depending on the design, by chipping glass away or roughening it thereby reducing its thickness at selected pits. This could result in stress raisers which might lead to an increased likelihood of breakages.

The high turnover of glasses in commercial establishments, due to loss and breakage, means that the cost of each glass must be as low as possible and any additional expense for treating the glass for nucleation be minimised.

The present invention arose in an attempt to overcome the above problems.

According to the present invention, there is provided a drinking vessel or fluid container wherein one or more nucleation sites are provided on the internal surface by applying a material suitable for providing nucleation sites, to the internal surface.

The material may be applied in a selected pattern and the vessel or container may be of glass.

Preferably the material is a textured one, which is preferably an ink in the form of a paste, which may comprise a soft lead bisilicate or soft bisilicate glass mixed with carriers which may be organic resins and/or solvents. The ink or other textured material may be printed upon the interior surface of the glass by using methods such as screen printing, pad printing, jet printing or heat transference. Alternatively, the ink may be injected onto the glass. Preferably, the process is done subsequent to manufacture of the vessel itself.

Although the paste is usually white, it is possible to add colouring agents, or to use different inks or pastes, to apply coloured material to the glass. Two or more colours may be applied, eg. in separate processing steps.

The glass may then be annealed by firing at a high temperature to cause the material to adhere to the body of the vessel. This temperature is preferably between 400° C. and about 700° C. In one embodiment, the temperature is 580° C. Generally, it will be required to raise the temperature gradually to the firing temperature, and then to lower it gradually to avoid cracking the glass.

The material may be applied to the bottom internal surface of the glass or other drinking vessel. The material is preferably applied as a pattern of dots or discrete spaced portions of material. The dots may be in any pattern and in one example comprise a series of coaxial radial rings. Most advantageously the material is applied, whether as a pattern of discrete portions or as a continuous pattern to form a shape of a logo or word, such as a Trademark. Alternatively, the pattern may be other than ringlike. It may comprise a random or pseudo-random pattern of dots for example. It may even be possible to apply the ink/paste in desired patterns such that bubbles formed by nucleation at the pattern will cause the head at the top of the beverage to take on a similar form. In this way, logos or advertising material may appear in the head of the beverage itself by forming the texture material in the shape of the logo for example.

According to the present invention in a further aspect there is provided a method of treating a drinking vessel or fluid container, comprising printing a material, suitable for providing nucleation sites, on to an internal surface of the container.

The vessel may be of glass.

Preferably the material is a paste which is applied as an ink, in which case the method may comprise applying the ink in a desired pattern onto a conformable body, applying the body to the internal surface of the vessel or container to transfer the ink pattern to the surface, and removing the body. The vessel or container may then be treated or annealed to cause the ink pattern to adhere to the surface of the vessel or container.

The ink/paste is preferably heated before being applied to the body, preferably to around 60° to 80°, typically 70°.

The invention is of course applicable to other types of glasses than those commonly used for beer, lagers, ciders or perries. It may, for example, be used on stemmed glasses, goblets or other glasses used for wine or on tumblers generally used for non-alcoholic drinks. The invention may also be applicable to other containers or vessels, eg. tankards, jugs or bottles.

Embodiments of the present invention will now be described, by way of example only, with reference to the accompanying drawings in which.

Figure 5A:
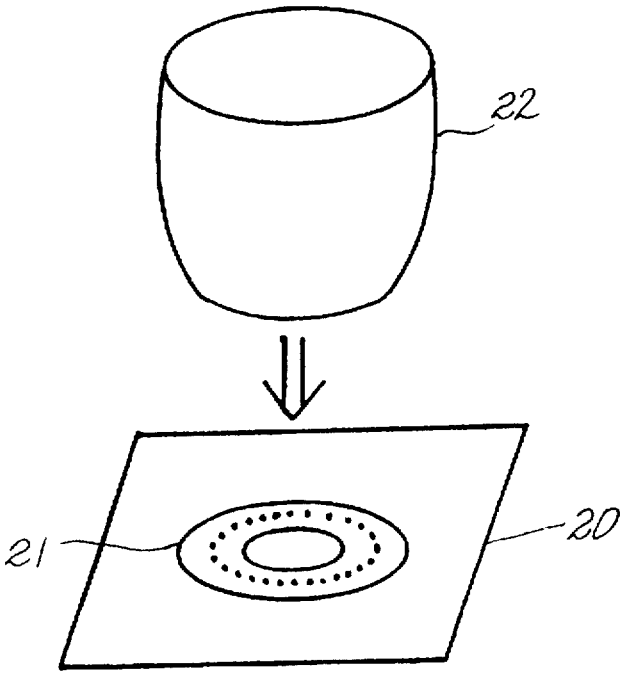
Figure 5B:
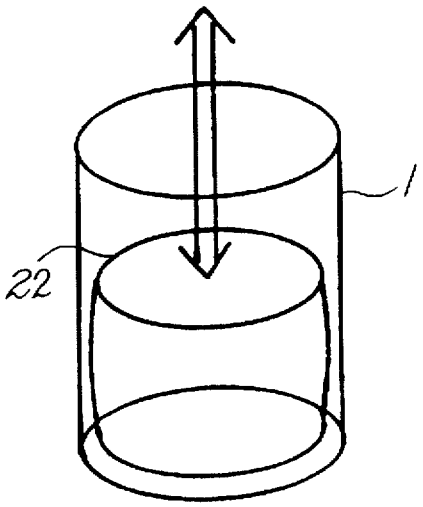
Figure 5C:
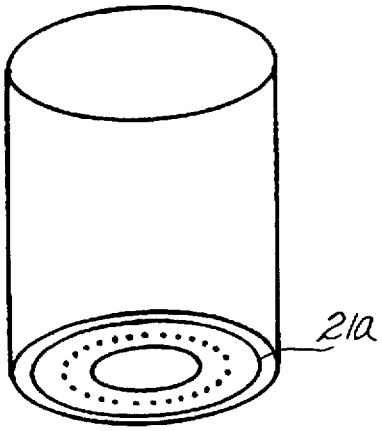
Figure 6:
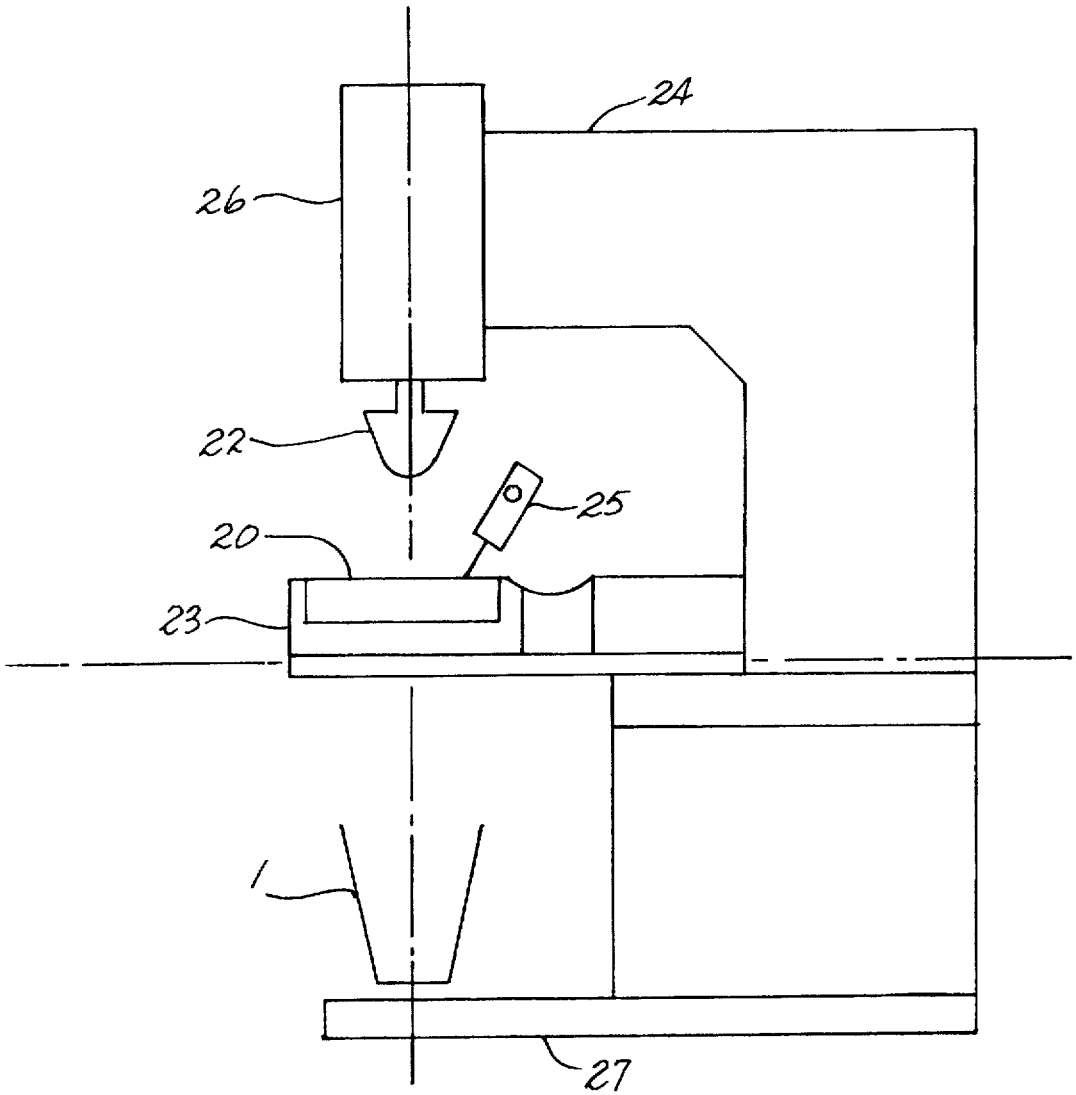

FIGS. 5*a*, 5*b* and 5*c* show a method of treating a beer glass according to the present invention;

FIG. 6 shows an apparatus for the treatment of a drinking vessel; and

FIG. 7, consisting of FIGS. 7A, 7B, 7C and 7D, shows the operation of the apparatus of FIG. 6.

Figure 1:
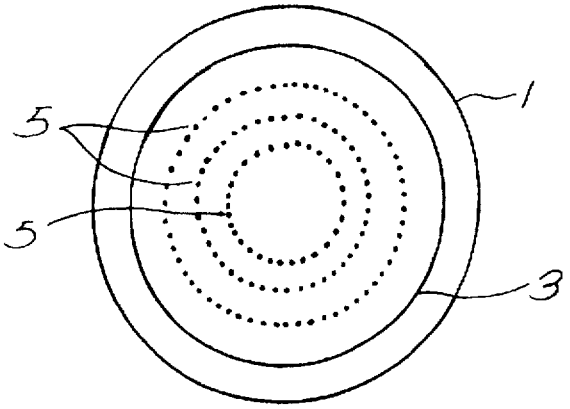
FIG. 1 shows a plan view of a beer glass when treated according to the present invention.
Figure 2:
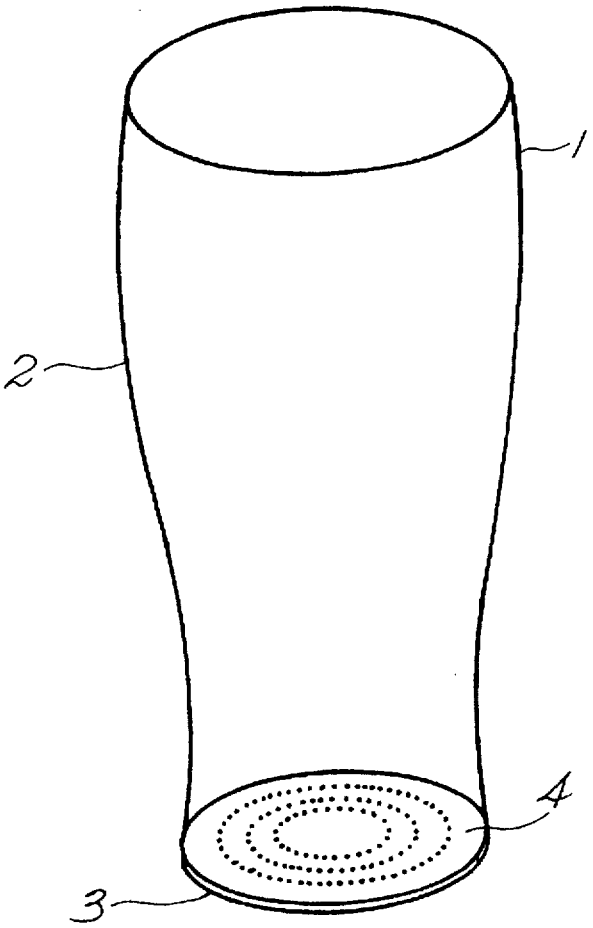
FIG. 2 shows a front view of the glass of FIG. 1.

Referring to FIGS. 1 and 2, beer glasses in the United Kingdom are generally intended to hold quantities of either a half a pint (0.285 liters) or one pint (0.57 liters) of beer, lager, cider or similar drinks. The figures show a one pint vessel 1 which has been treated in accordance with the invention. The glass comprises an annular side wall 2 and a base 3. The inner face 4 of the base is treated to have a plurality of annular rings 5 of a material suitable to induce nucleation in the beverage. This will usually be a different material than the glass of which the vessel is formed. The annular pattern shown in FIGS. 1 and 2 is by way of example only and many other patterns may be appropriate. Indeed, more commonly the pattern may be a logo, for example a brewery or promoters logo or Trademark.

The treatment (as described below) is such that it provides nucleation sites on the base of the vessel which encourage the formation of bubbles at the sites when a beverage containing carbon dioxide or other gas or gas combination is held within the vessel. Thus, when a beverage such as a lager is held by the vessel a continuous stream of bubbles will emanate at the nucleation sites provided by annular rings 5 and rise towards the top of the beverage which will prolong the existence of head on the lager.

The arrangement shown has a pattern of material. It has been found preferable to apply the material as a series of dots forming the overall pattern. These dots enhance the nucleation inducing effect.

Preferably, the material used to treat the glass is an ink or paste material which may be a soft lead bisilicate glass or soft bisilicate glass if it is desired to use lead-free products. These compounds come as powders which may be mixed in carriers based on organic resins and solvents to produce a paste. The materials may be similar to those used to print on glass, particularly on the external sidewalls of drinking glasses, as is commonly done on beer glasses to reinforce brewery branding and Trademarks for example. This makes the treatment particularly effective and able to be used at the same time as external printing is done on the glass. It should be noted that treatment according to the invention is preferably done after manufacture of a glass and thus is in effect done on standard glasses after manufacture thereof.

The ink, paste or other treatment material may be directly printed on to the inner face of the base of the glass by using pad printing techniques. Pad printing is known under many names such as Murray Curvett printing, cliché printing, tampo printing or soft-touch printing. One example is shown in FIG. 5. A plate 20, typically of metal or a plastics material, is firstly engraved or etched with the desired pattern 21. The plate is then inked with the chosen ink material, which is generally in the form of a thick paste. In a preferred embodiment, the paste is heated, for example to between 40° C. and 100° C., typically 70° C., before being applied to the plate. This tends to give a thicker ink deposit and improves the final image. The ink is then removed, typically by a squeegee or wiped, leaving ink deposited in the engraved or etched area. Alternatively, a screen printing process may be used in which the ink/paste is screen printed onto substrate.

A pad 22 is then pressed upon the plate (eg. the engraved or screen printed plate), covering the engraved area, and removed, thus drawing ink from the engraved area onto the pad. The pad is of an elastomeric, preferably resiliently-conformable and/or compressible material and may be of a range of suitable materials, such as silicone, silicone rubber or gelatine. The base of the pad may be flat or, preferably, has a generally curved, conical structure as shown in FIG. 5(*a*). Other shapes may be used. The pad is conformable to be able to take up the contours of the plate and also to be able to fit within the side walls of a glass to be treated.

Inked pad 22 is then inserted into a glass 1 to be treated, so that the ink pattern is transferred from pad 22 to the base surface of the glass as shown at FIG. 5(*b*). It has been found that substantially all of the ink is transferred from the pad to the glass at this stage. The pad is then removed, leaving an ink pattern 21*a* on the base of the glass (FIG. 5*c*). In a preferred method the glass is then annealed by firing the ink pattern into the glass by heating to a high temperature, typically between 400° and 700° C. One typical temperature is 580° C. This firing causes the liquid material to fuse itself to the glass body of the vessel.

The heating and cooling must be done gradually, so that the temperature rise or decrease experienced by the glass is gradual to reduce or eliminate the risk of stress fractures. In one embodiment, the glass passes slowly, on a conveyor for example, through an oven having a first zone at approximately 330° C., a second zone at approximately 580° C., a third zone at approximately 500° C. and a fourth zone at approximately 360° C., the whole heating/cooling process taking approximately two hours. After cooling, the material forms a substantially permanent, non-removable part of the vessel.

The treatment process may be done in many different ways. For example, the plate and pad may be respectively hand inked and depressed, or the process may be fully automated. Other inking methods such as screen printing, jet printing directly into a glass, transfer heat branding or other direct heat printing may alternatively be used.

Figure 3:
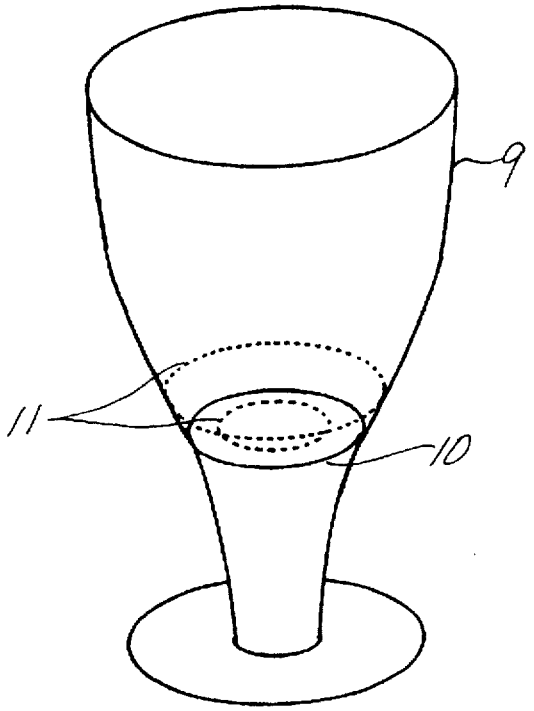
FIG. 3 shows an alternative style of glass.

The invention is of course applicable to other types of glasses or drinking vessels than those commonly used for containing drinks such as beer, lagers and ciders. FIG. 3 shows an embodiment in the form of a stemmed wine glass 9. In this case, the pattern is formed both on the inner bottom face 10 of the glass but also extending partially up the side of the glass in annular rings 11. This can produce a pleasing bubbles effect in a sparkling wine or champagne. Many other configurations of glass and treatment pattern are possible.

Figure 4:
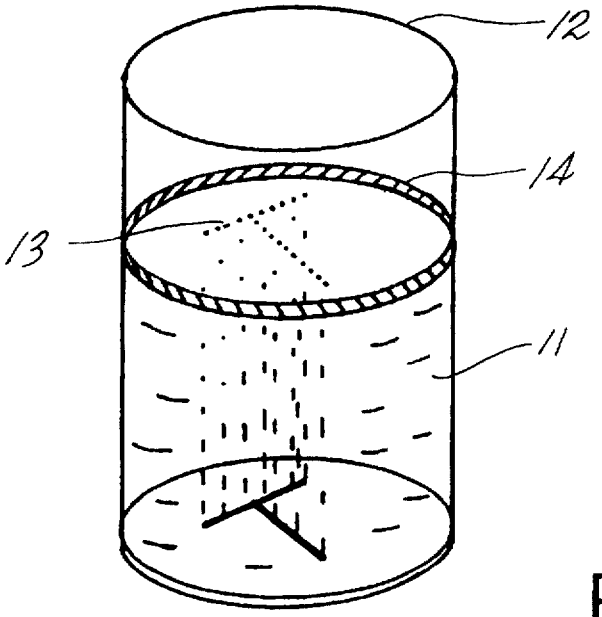
FIG. 4 shows an alternative embodiment of a glass treated according to the invention and containing a beverage.

FIG. 4 shows an alternative arrangement of the treatment pattern in the form of a recognizable character (in this case a letter T). Since nucleation will tend to happen at the treated area the pattern of bubbles formed on the top of a beverage 11 within glass 12 may under certain circumstances tend to reproduce the treatment pattern and hence a reproduction of the letter T may appear at 13, forming part of the head 14 of the beverage.

In another embodiment the treatment pattern may be a random or pseudo-random pattern of dots. Such a pattern is less prominent and less visible than the pattern shown in FIG. 1 which may be advantageous in some circumstances.

It is seen from the above embodiments that the effect of treating a glass is to produce a "roughened" or undulated area on an internal surface of the glass to encourage nucleation to occur at this treated portion. As an alternative to the printing ink already described, any suitable textured (eg. particulate) material may be used. Preferably this should comprise particles which are firmly and non-removably adhered to the respective portion of the glass to produce nucleation sites. It is of course important that the materials are applied by a process which permanently adheres them to avoid the material polluting a beverage.

It will be appreciated that application of the treatment according to the present invention to a glass should not weaken the glass structure since it does not remove any of the original glass material but instead adds further material.

FIGS. 6 and 7 show one example of an apparatus for performing the treatment operation outlined above. As shown in FIG. 6, an engraved plate 20 is mounted upon a table 23 which is slidable horizontally in the figure. Table 23 is mounted on a vertical support 24 which also supports a lower table 27, for supporting a glass to be printed. Instead of table 27, a conveyor may be positioned so that glasses are brought in turn to a desired position. Support 24 also supports a mechanism 26 for raising and lowering a pad 22 as described above. The mechanism may be mechanical, electrical, pneumatic or hydraulic for example, or may be manually operated to raise or lower pad 22. The design of such apparatus is well known. Tray 23 is movable relative to a squeegee 25.

FIG. 7 shows an operating cycle of the apparatus of FIG. 6. Plate 20 is firstly mounted upon tray 23 and inked either automatically (by an injection of ink onto the plate for example) or manually, with an ink or paste as described above. The ink is preferably preheated as described above. The plate is then slidably displaced, under squeegee 25, to a position under pad 22. Excess ink is removed by the squeegee, leaving ink only in the desired pattern. Alternatively, a screen printing or other technique may be used. Methods of screen printing are well known.

Pad 22 is then lowered, as shown in FIG. 7(*b*), to contact the plate and thereby transfer the ink pattern from the plate to the lower surface of the pad. The pad is then raised again, and tray 23 (with plate 20) is retracted, as shown in FIG. 7(*c*). A glass 1 is already positioned upon lower support 27, or is brought into position, with its center axis substantially in line with the axis of movement of pad 22 (ie. directly below the pad). Pad 22 is then lowered, as shown in FIG. 7(*d*), sufficiently to contact the internal base surface of the glass to thereby transfer the ink pattern from the pad to the glass. As shown, the pad may deform. The pad is then raised, and the glass removed, or moved onwards on a conveyor. Plate 20 is then re-inked and the cycle repeats.

Other methods of printing the ink/paste will be apparent.

I claim:

1. A drinking vessel or fluid container wherein one or more nucleation sites are provided on an internal surface by applying an ink or paste material suitable for providing nucleation sites to the internal surface, the material being printed upon the surface and non-removably adhered thereto in the presence of a drinking fluid in the vessel.

2. A drinking vessel or fluid container as claimed in claim 1, wherein the material incorporates glass particles.

3. A drinking vessel or fluid container, as claimed in claim 2, wherein the material comprises soft lead bisilicate or soft bisilicate glass.

4. A drinking vessel or fluid container as claimed in claim 1, wherein the material is provided as a pattern of dots or discrete, spaced, portions of material.

5. A drinking vessel or fluid container as claimed in claim 1, wherein the material forms the shape of a logo.

6. A drinking vessel or fluid container as claimed in claim 1, wherein the vessel or container has a base and the material is applied to the internal surface of the base of the vessel or container.

7. A drinking vessel or fluid container as claimed in claim 1, wherein the material forms the shape of one or more words.

8. A method for providing nucleation sites on the internal surface of a drinking vessel or fluid container, comprising printing an ink or paste material suitable for providing nucleation sites upon the surface, and causing the material to non-removably adhere to the surface in the presence of a drinking fluid in the vessel.

9. A method as claimed in claim 8, wherein the material incorporates glass particles.

10. A method as claimed in claim 8, wherein the material is applied to the surface by an elastomeric body.

11. A method as claimed in claim 8, comprising providing a desired pattern of the material on a first body, transferring at least part of the material to a second, elastomeric body, transferring at least part of the material from said body to a desired part of the vessel or container, and causing the pattern to adhere or fuse to the vessel or container.

12. A method as claimed in claim 11, wherein the material is heated before being applied to the first body.

13. A method as claimed in claim 11, wherein the first body is an engraved plate.

14. A method as claimed in claim 11, wherein the second elastomeric body is of silicone, silicone rubber or gelatine.

15. A method as claimed in claim 8, wherein a heat treatment is applied to cause the material to fuse to the vessel or container.

16. A drinking vessel or fluid container, when treated by a method as claimed in claim 8.

* * * * *